United States Patent [19]

Randleman

[11] Patent Number: 4,545,577

[45] Date of Patent: Oct. 8, 1985

[54] MAZE GAME DEVICE

[76] Inventor: Randy J. Randleman, P.O. Box 470, Gowrie, Iowa 50543

[21] Appl. No.: 557,609

[22] Filed: Dec. 2, 1983

[51] Int. Cl.[4] ..... A63B 67/14

[52] U.S. Cl. ..... 273/113

[58] Field of Search ..... 273/109, 110, 113, 120, 273/138, 155, 236, 284, 287, 1 G, 1 GG

[56] References Cited

U.S. PATENT DOCUMENTS

| | | | |
|---|---|---|---|
| 2,899,206 | 8/1959 | Carter | 273/120 |
| 3,488,052 | 1/1970 | Weisbecker | 273/1 R |
| 3,610,628 | 10/1971 | Promin | 273/138 |
| 3,747,937 | 7/1973 | Fabricani | 273/113 |
| 3,785,651 | 1/1974 | Smith | 273/113 |
| 3,787,054 | 1/1974 | Stafford | 273/109 |
| 4,008,895 | 2/1977 | Reiner | 273/113 |
| 4,136,542 | 1/1979 | Robison | 273/290 |

*Primary Examiner*—Richard C. Pinkham
*Assistant Examiner*—Benjamin H. Layno
*Attorney, Agent, or Firm*—Zarley, McKee, Thomte, Voorhees & Sease

[57] ABSTRACT

A maze game device for moving one or more game objects from a starting position to a finish position which includes a housing enclosing a plurality of tunnels which are movable in location within the housing in response to the depressment of buttons which extend outwardly from various locations on the housing and the concurrent tilting and orienting of the housing. The game object or objects are maneuverable from the starting location to the finish location by orientating the housing and depressing the buttons either singly or in combination to align the tunnels to provide a path for moving the game object from the starting location to the finish location.

22 Claims, 25 Drawing Figures

MAZE GAME DEVICE

BACKGROUND OF THE INVENTION

1. Field of the Invention

This invention relates to manually operated skill toys, more particularly, to manually operated maze toys for moving one or more game objects to desired locations.

2. Description of the Art

There are many maze game toys which have been patented. Some of these devices use barricades around which must pass the game object to get to a finish location, whereas other devices utilize openings or tunnels through which the game object must be maneuvered. Further still, some maze game devices utilize manually operated controls to help facilitate the movement of the game object.

The present maze game device requires the single or combined manual operation of game controls and concurrent tilting or orientating of the device to facilitate the movement of a game object through the toy.

It is therefore an object of this invention to provide a maze game device which presents movable tunnels which must be orientated in correct positions to facilitate the travel of a game object to a desired location by the manual operation of single or combined game controls.

It is a further object of this invention to provide a maze game device which requires the correct movement and orientating of tunnels and the tilting or constant orientating of the device to facilitate the movement of the game object.

A further object of the invention is to provide a maze game device which requires different combinations of manual operation of game controls to facilitate the movement of the game object.

Another object of the invention is to provide a maze game device which allows the user to determine the progress of the game object through the toy visually or by touch, or both.

A further object of this invention is to provide a maze toy which is economical, durable, and challenging.

Additional objects, features and advantages of the invention will become apparent with reference to the accompanying description and drawings.

SUMMARY OF THE INVENTION

This invention utilizes a housing having a hollow interior containing a plurality of movable tunnels. A plurality of game controls extend into the housing at various locations and are operatively connected to specified tunnels. Upon manual operation of one or more game controls, the respective tunnels are moved in relation to other tunnels within the housing.

One or more game objects are allowed access into the housing through one or more openings in the housing by the depressment of the particular game control which aligns a tunnel directly beneath the opening in the housing. The game piece is then maneuvered through the housing by means of both depressing a game control or a combination of game controls and tilting and orientating the housing in different positions to cause the tunnels to provide a path for the game object to a desired location and to cause the game objects to then follow that path.

DETAILED DESCRIPTION OF THE PREFERRED EMBODIMENT

Figure 1:
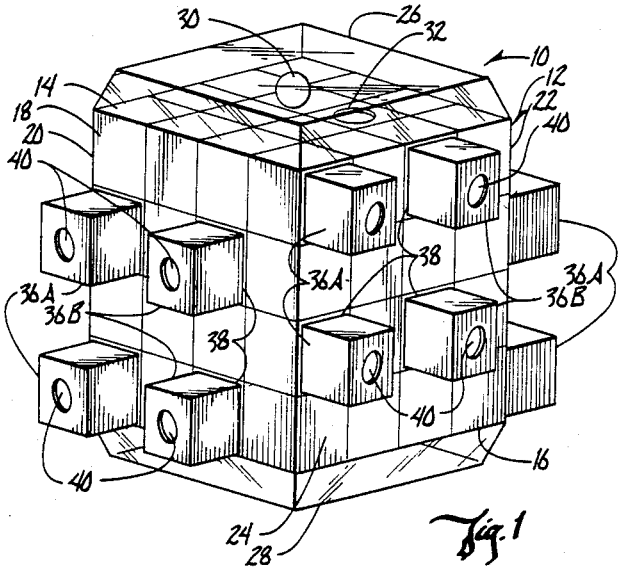
FIG. 1 is a perspective view of one embodiment of the invention.

In reference to the drawings, and particularly FIG. 1, there is shown a maze game device 10 according to the invention. A cubical housing 12 having a top wall 14, a bottom wall 16, and sidewalls 18, 20, 22 and 24 enclose a hollow interior.

In one embodiment of the invention, two transparent covers 26 and 28 are placed over top wall 14 and bottom wall 16 respectively. These covers serve to contain one or more game objects such as ball 30. An opening 32 is placed in top wall 14 to allow communication of ball 30 with the interior of housing 12. Likewise, an opening 34 (not shown) exists in bottom wall 16.

The game controls consist of sixteen depressible button members 36 which extend through mated openings 38 in sidewalls 18, 20, 22 and 24 into the interior of housing 12. Button members 36 have peepholes 40 in their outwardmost ends which serve as windows to view whether the ball 30 is within that certain button member 36.

Figure 2:
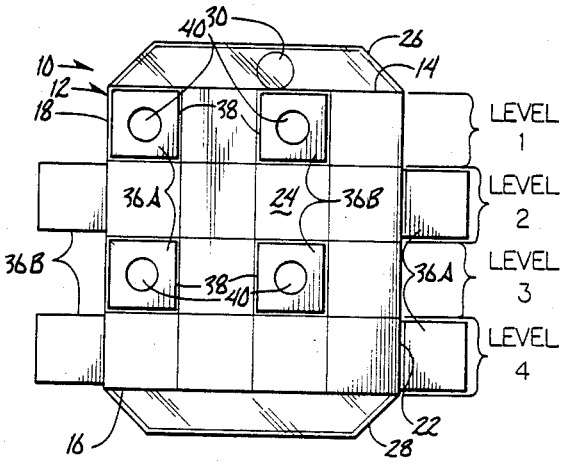
FIGS. 2 and 3 are elevational views of the adjoining sides of the invention shown in FIG. 1.
Figure 3:
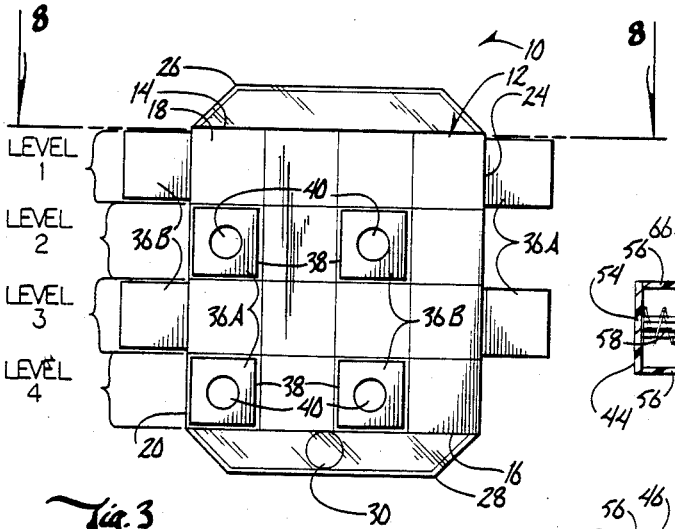

FIGS. 2 and 3 show the exact orientation of button members 36 to one another. Button members 36 exist in four levels (shown in FIGS. 2 and 3), each level having two sets of two button members disposed on opposite sidewalls. FIG. 2 depicts the position of button members 36 on sidewall 24, whereas FIG. 3 shows the positioning of the buttons with respect to sidewall 18. It can be seen that in this embodiment, button members 36 are vertically and horizontally spaced from one another in a uniform manner such that button members 36 on opposite sidewalls in the same level are parallelly interlaid in the same horizontal plane. (This can be seen more clearly in FIGS. 8–24.) In comparison, button members 36 of adjacent sidewalls (such as sidewalls 18 and 24) are overlaid in four levels each level of buttons being perpendicular to those in the preceding level in their horizontal positioning.

In the embodiment shown in the drawings, each top, bottom and sidewall of housing 12 is 2-¼ inches wide and 1/32 inch thick. Each button member 36 is square in cross-section and 9/16 inch wide. The openings 32 and 34 are 19/64 inch in diameter and ball 30 is of a sufficient diameter to pass through openings 32 and 34. Covers 26 and 28 have at least $\frac{3}{8}$ inch from top and bottom walls 14 and 16 respectively to allow ball 30 to roll freely within covers 26 and 28. As can be seen in the drawings, covers 26 and 28 can be beveled in at the side edges to present a pleasing, aesthetical appearance. However, it is to be noted that they can be of other shapes achieving the same result.

Figure 5:
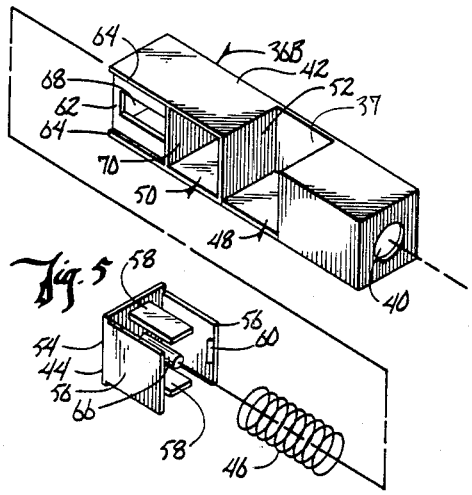
FIG. 5 is an exploded perspective view of a double-action button member game control.
Figure 4:
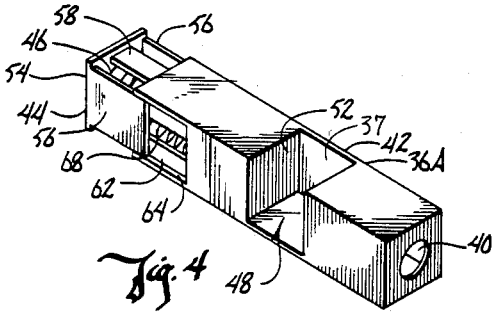
FIG. 4 is a perspective view of a single-action button member game control.

FIGS. 4 and 5 depict the two types of button members 36 which are used in the embodiment of the invention 10 shown in the drawings. For purposes of reference, FIG. 4 depicts single-action button member 36A, whereas FIG. 5 depicts double-action button member 36B.

Both single-action and double-action button members 36A and 36B are generally of the same configuration in the perferred embodiment, namely being elongated, and square-in-cross-section, and hollow. Button members 36A and 36B are comprised of a movable part 42, an anchor part 44 and a spring 46. The distinction between button members 36A and 36B is that button member 36A has a single passageway 48 whereas button member 36B has passageway 48 and a tunnel 50.

Passageway 48 is formed by removing a portion of the top and one sidewall of button member 36, leaving a side portion 37 which can be on either side of the button depending on location in the device 10, and placing a retaining wall 52 across button member 36 at the rear of the opening. The game object or ball 30 can thus pass into and out of passageway 48 of single-action button 36A from one side or from above. Additionally, single-action button 36A is hollow from passageway 48 portion to its tip at peephole 40, so that the ball 30 can be rolled down to peephole 40 and thus it can be either visually or manually determined that ball 30 is within that particular button member 36.

Double-action button member 36B is exactly the same as single-action button member 36A except a tunnel opening 50 is created by removing portions of the sidewalls of button member 36 behind the position of passageway 48. Retaining wall 52 remains and thus a lateral pathway through double-action button member 36B is created by tunnel 50.

Button members 36 are resiliently depressible which is made possible by anchor part 44 and spring 46. Anchor part 44, in the preferred embodiment, comprises a square base 54 having two runners 56 extending perpendicularly from two opposite sides of the base. Two guide members 58 extend perpendicularly in the same direction as runners 56 from the two other opposite sides of base 54. Runners 56 have end limit tabs 60 extending inwardly toward each other from their outermost ends. Spring 46 is positioned over post 66, which is attached to base 54 within the enclosure formed by runners 56 and guide members 58. Spring 46 abuts base 54 at one end.

The inwardmost end of movable part 42 has indented walls 62 on opposite sidewalls. Indented walls 62 cooperate with lips 64 formed by the top and bottom sides of button members 36 to create a channel into which fit runners 56 of anchor part 44. Additionally, indented walls 62 contain longitudinal slots 68 into which fit end limit tabs 60 of anchor part 44.

The end of spring 46, opposite to that abutting base 54 of anchor part 44, abuts second retaining wall 70 of movable part 42.

Figure 6:
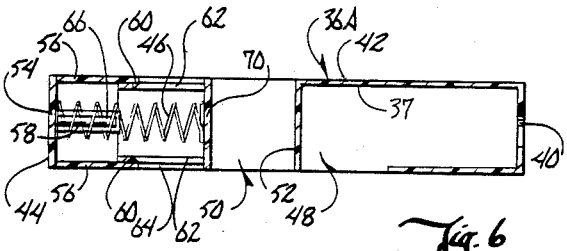
FIG. 6 is a cross-section of the double-action button of FIG. 5 in assembled form with the spring in its relaxed position and the button in an extended position.
Figure 7:
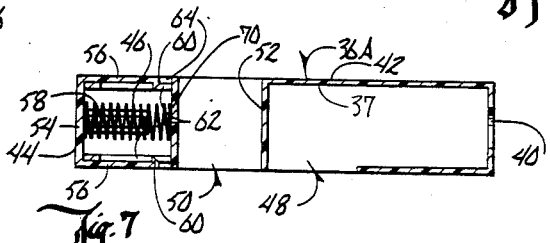
FIG. 7 is a cross-sectional view of the double-action button member of FIG. 5 in assembled form with the spring in a compressed state and the button in a depressed position.

By referring to FIGS. 6 and 7, the spring action of button member 36 can be seen. In the normal relaxed and extended position of spring 46, movable part 42 is urged away from anchor part 44 by spring 46. End limit tabs 60 in slots 68 prevent movable part 42 and anchor part 44 from separating. Guide members 58 assist in keeping spring 46 centered with respect to anchor part 44 and blocks entrance of ball 30 into anchor part 44. When button member 36 is depressed, spring 46 is compressed, as shown in FIG. 7. End limit tabs 60 slide forward in slots 68 and runners 56 slide forward in the channels created by indented wall 62 and the lips 64 of the top and bottom of button members 36. Slots 68 create an allowable depressible distance equal to the width of passage 48 or tunnel 50.

Upon removal of a force depressing button member 36, spring 46 acts to decompress and push movable part 42 back to its original position as shown in FIG. 6.

It can thus be seen that the structure of button members 36, including single-action button 36A and double-action button 36B, provide a variety of tunnels or passages which can be selectively moved by the depressment of the buttons 36 so that a maze is created through the interior of the housing 12.

The preferred embodiment of the invention shown in the drawings utilizes four button members 36 on each sidewall 18, 20, 22 and 24 of housing 12. Each button member 36 which is adjacent a corner of housing 12 is of the general configuration of button members 36A (as shown in FIG. 4), whereas all remaining button members 36 are of the general configuration of button member 36B (as shown in FIG. 5). All button members 36B are always oriented in housing 12 of FIG. 1 as shown in FIG. 5 so that the tunnels 50 are uniformly horizontal throughout the device except that button members 36B in two locations on housing 12 have sidewalls 37 which are placed on the opposite side of the button member from that shown in FIG. 5, and the buttons are rotated 180° in the housing. These two buttons are button members 36B on sidewall 20. All button members 36A are constructed as shown in FIG. 4 and can be positioned within housing 12 in either the manner shown in FIG. 4 or rotated 90°, 180°, or 270° therefrom depending on what passageway orientation is needed.

It is to be understood that housing 12 could be of a variety of configurations, in particular, housing 12 could be elongated to present retangular sidewalls with any number of button members 36. For example, a game device 10 according to the invention is contemplated having 12 button members 36 per sidewall, interlaid the same way as described above. It is also to be understood that different combinations or configurations of tunnels could be produced to create variations in how the game object is maneuvered through the housing 12.

The manner by which button members 36 are positioned within housing 12 is such that anchor part 44 of each button member 36 is anchored against the sidewall opposite from that which button member 36 extends outwardly from. Each button member 36 therefore spans the entire width of housing 12, and the interlaying method of positioning button members 36 fills up the entire interior of housing 12.

By referring to FIGS. 8–25, the method by which ball 30 can be maneuvered through the housing 12 from outside of top wall 14 to outside of bottom wall 16 is illustrated. FIGS. 8–24 uniformly depict device 10 in the same orientation, even though device 10 must be tilted and turned to adequately manipulate ball 30.

Therefore, as can be seen, sidewall 20 is always depicted facing the top of the page, sidewall 18 facing the left side of the page, sidewall 22 facing the right side, and sidewall 24 facing the bottom of the page.

Figure 8:
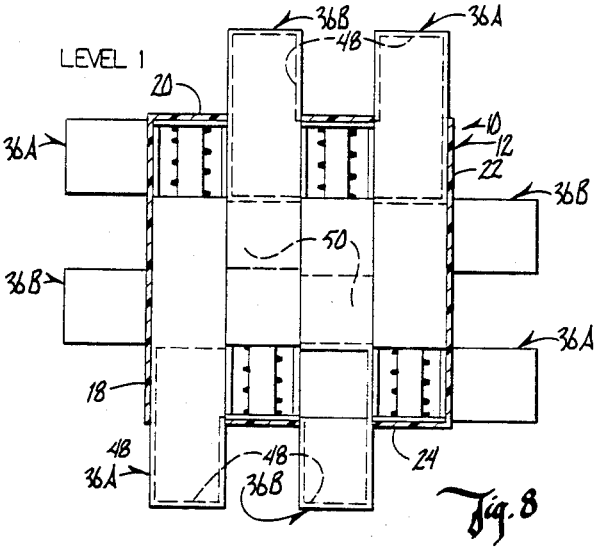
FIGS. 8 through 24 depict in cross-sectioned form the passage of the game object through the different levels of the invention by the manipulation of button member game controls for one embodiment of the invention.

FIG. 8 is a cross-section of device 10 taken along line 8—8 of FIG. 3. FIG. 8 shows the orientation of button members 36 for the various levels and how springs 46 function to extend the button 36. The dashed lines indicate passageways 48 and tunnels 50 for button members 36 of level 1.

Figure 9:
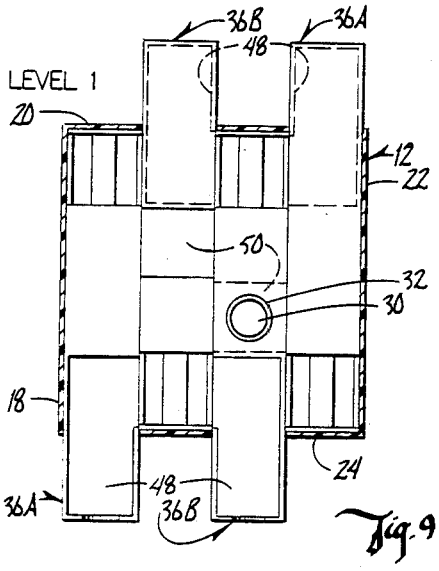

FIG. 9 illustrates only level 1 of the device and ball 30 as it would appear if manually maneuvered immediately within opening 32 in top wall 14 before the button member 36 beneath opening 32 is depressed. The top portion of the button 36 blocks passage of ball 30 into housing 12. However, when this button member 36 is pushed, passageway 48 would become aligned with opening 32 and ball 30 would fall into this passageway 48.

Figure 10:
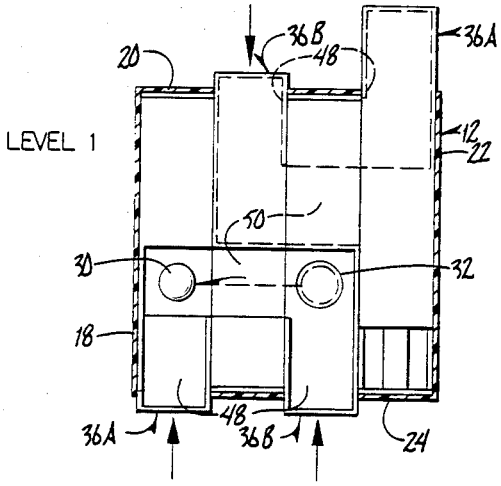
Figure 11:
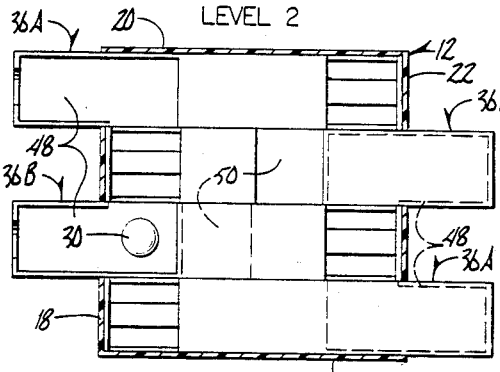

The next step is shown at FIG. 10 which still illustrates level 1 of the device. The depressment of a combination of button members 36, indicated by the arrows, would align their respective passageways and tunnels and to allow ball 30 to pass therethrough upon the tilting of the housing 12 in the direction of located ball movement (dashed arrow) and then drop out of the leftmost button member 36 in FIG. 10 downwardly into the second level of buttons, as shown at FIG. 11. Thus, at this point in FIG. 11, ball 30 is in the second level of button members 36 down from the top of housing 12. It should be noted that if the user were moving ball 30 in a reverse counter-clockwise direction through housing 12 from bottom wall 16 to top wall 14 that ball 30 will not drop automatically into the succeeding level as described above, but requires the user to release the three buttons being pushed in combination and depress alone the button in the succeeding level into which it will drop to receive the ball 30.

Figure 12:
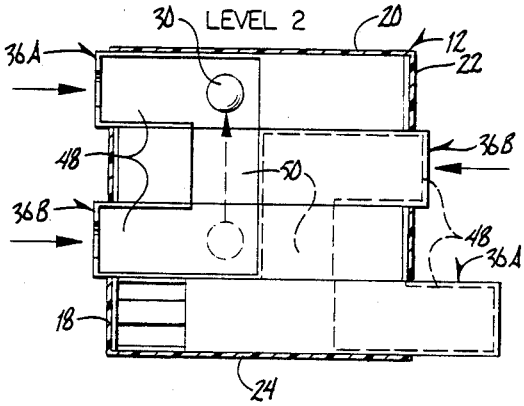

At this point, a combination of three level 2 button members 36 can be pushed as indicated by the arrows in FIG. 12. The tunnels of these three depressed button members 36 are thus aligned in such a manner that ball 30 will travel from its position in FIG. 11 to the position shown in FIG. 12 (see dashed arrow line) when the device is tilted in that direction.

Figure 13:
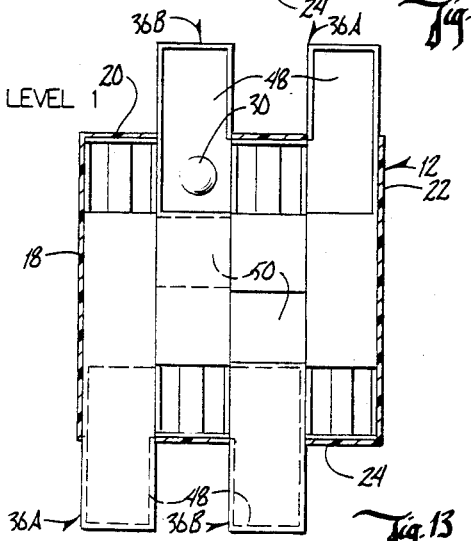

At this time, or while pushing in these three button members 36 on level 2, housing 12 must be flipped over so that bottom wall 16 is now face up to the user. Keeping the uppermost button shown in FIG. 12 depressed when flipping the device over, will cause ball 30 to drop back into level 1 (now on bottom) of button members 36 as shown in FIG. 13. It is again to be understood that the drawings in FIGS. 8–24 show the device 10 in cross-section in the same orientation in every figure, but that in order to get ball 30 back up to the position in level 1 shown in FIG. 13, the cube must be turned over.

Figure 14:
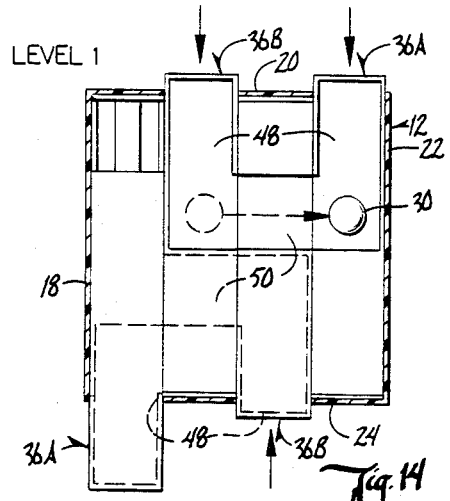
Figure 15:
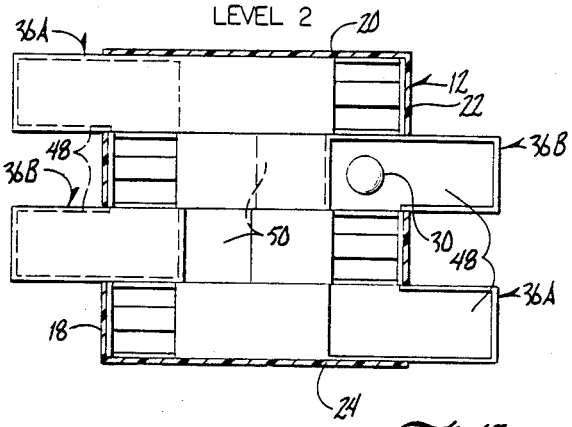
Figure 16:
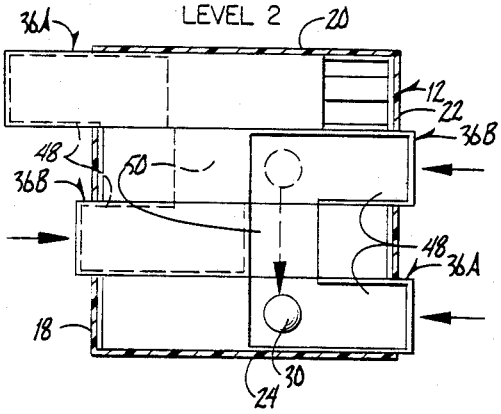
Figure 17:
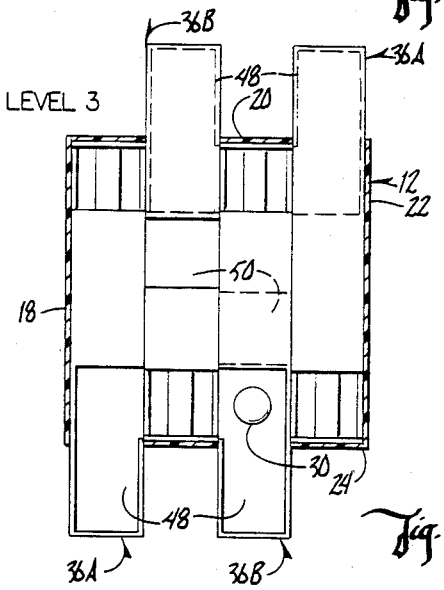
Figure 18:
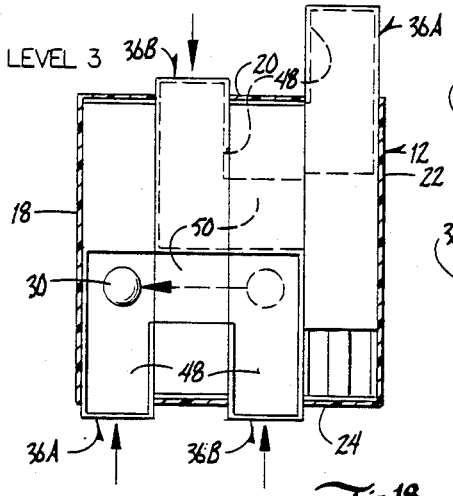
Figure 19:
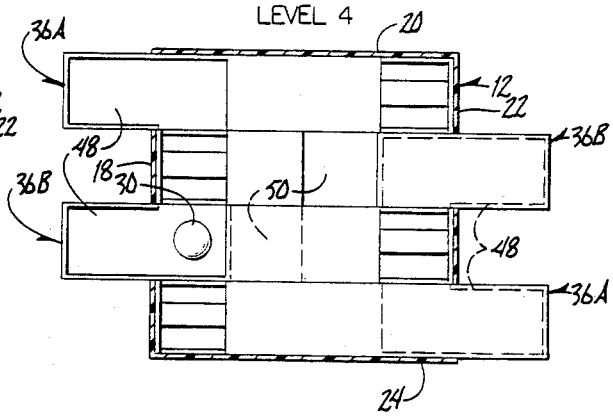

By returning the cube back right side up (top wall 14 facing up) and depressing the combination of three button members 36 as depicted by the arrows in FIG. 14, ball 30 will travel through the three depressed buttons and fall back into level 2 as shown in FIG. 15. At this point, ball 30 is in level 2 of button members 36 and has traveled around all four sides of the housing 12. FIG. 16 depicts the similar depressment of the combination of three button members 36 in level 3 (see solid arrows) which causes ball 30 to travel through those three buttons and drop into level 3 as shown in FIG. 17 upon manual tilting of the device in the direction of the dashed arrow of FIG. 16. FIG. 18 again shows the combination of three button members 36 being depressed as shown by the solid arrows and results in ball 30 ending up in the fourth or bottom level of button members 36 as shown in FIG. 19.

Figure 20:
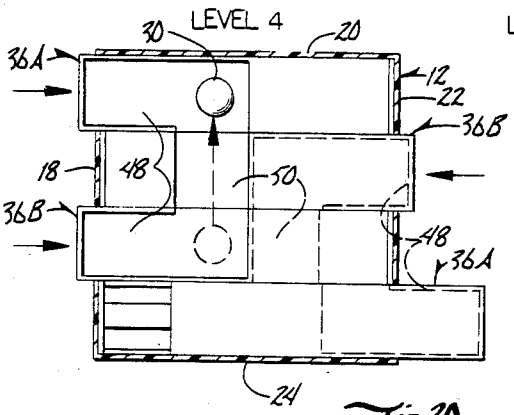
Figure 21:
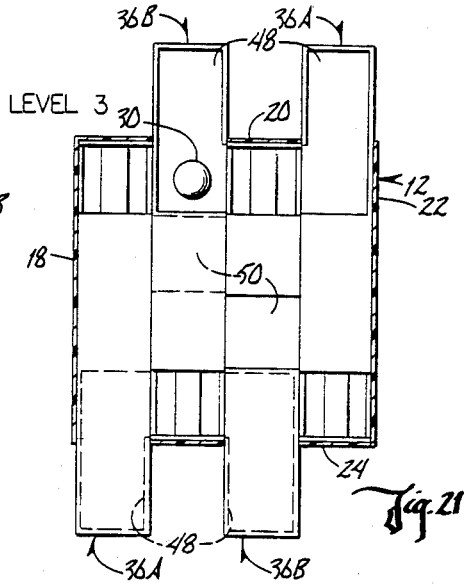
Figure 22:
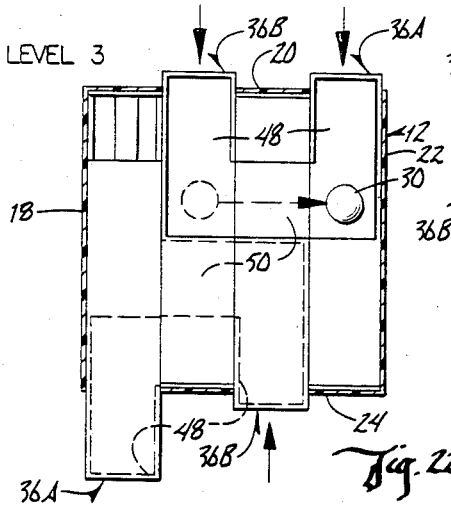
Figure 23:
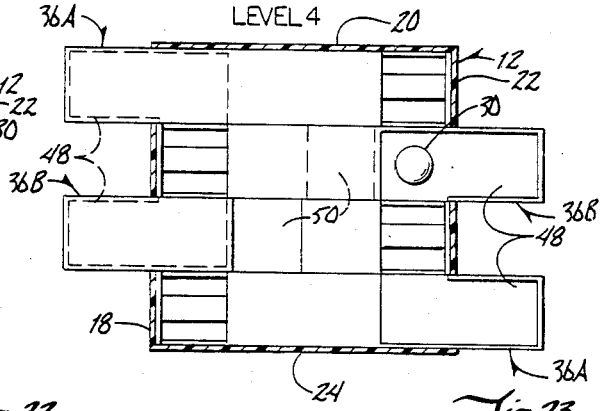

Utilizing similar procedure, the three button members 36 as indicated in FIG. 20 are then depressed and the device 10 again turned upside down which causes ball 30 to drop back to level 3 (now below level 4) as depicted in FIG. 21. By then turning the device back right side up, pressing the combination of three button members 36 shown in FIG. 22, and tilting the device in the direction of the dashed arrow of FIG. 22, ball 30 passes through those three buttons back into level 4, to the position shown in FIG. 23.

Figure 24:
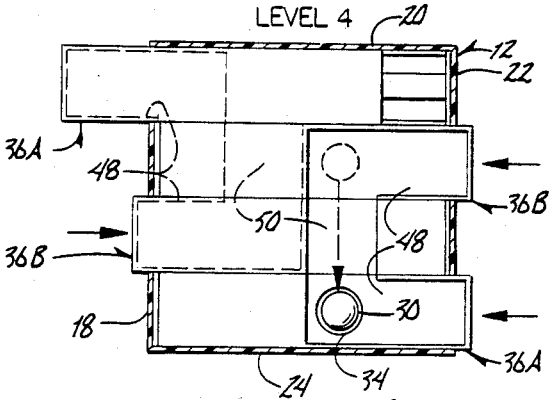

Finally, the depressment of the combination of buttons shown by the solid arrows in FIG. 24 and tilting of the device in the direction of the dashed arrow allows ball 30 to travel into the lowermost button member 36 shown in FIG. 24 and by appropriate maneuvering of housing 12 fall through opening 34 in bottom wall 16 and be captured in transparent cover 28 covering bottom wall 16.

This would complete the maneuvering of ball 30 through the cube for one embodiment of the maze game. It can be seen, in this embodiment, that a repeated combination of steps is used to facilitate successful maneuvering of ball 30 through the maze.

Figure 25:
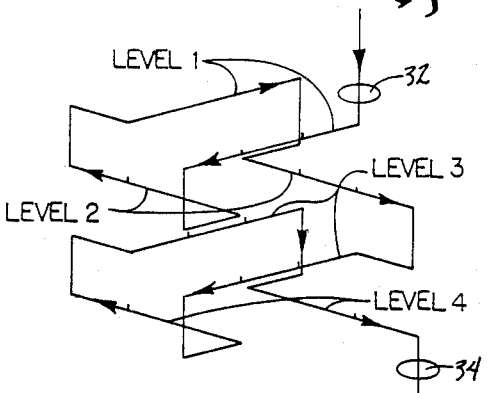
FIG. 25 is a schematic showing the path of the game object through the invention in the embodiment of the invention shown in FIGS. 1 through 24.

FIG. 25 schematically depicts the systematic travel of ball 30 in its continually clockwise path around the housing 12. It is also again pointed out that the device 10 must be flipped over twice, causing ball 30 to naturally move back "up" a level before it can continue in a clockwise direction and move back down into the next lower level until to the bottom level.

To maneuver ball 30 through maze game device 10 back to underneath transparent cover 26 covering top wall 14, a reverse procedure is simply used to that described above. Ball 30 would thus travel in a counter-clockwise direction around the sidewalls of housing 12 in a path the reverse of that shown in FIG. 25.

It can thus be seen that the successful operation of the maze game device 10 requires a combination of correct depressment of button members 36 and accurate tilting and orientation of housing 12 to facilitate the maneuvering of ball 30 through the maze. Peepholes 40 allow the user to know which button member 36 the ball 30 is in by either visual verification or by touch by tilting housing 12 toward the user so that ball 30 rolls up to peephole 40.

Because of tunnel 50 in button member 36B, ball 30 can sometimes get trapped out of visual or touch verification if the three-button move as shown is not completed. This then requires a trial and error procedure of pushing buttons and tilting the cube to retrieve ball 30 from obscurity.

It is also noted that each sidewall 18, 20, 22 and 24 could be each colored differently to provide a reference for the user to distinguish different locations on the device 10. Top wall 14 and bottom wall 16 can also be of different colors to allow the user to distinguish between top and bottom.

It is to be understood that the number of button members 36 and the length of housing 12 could be extended to present any number of different combinations of game play similar to that described above.

Another embodiment of the invention 10 would consist of the basic configuration of the device as shown in FIG. 1, but having a plurality of game objects or balls 30 under either top or bottom transparent covers 26 and 28 and having transparent button members 36. If device 10 had four button members 36 per side, for a total of sixteen button members 36, sixteen balls could be maneuvered from under top cover 26 so that one ball 30 ends up in each button member 36. This challenge would be enhanced by coloring differently each sidewall of housing 12 and then having four sets of four balls 30, each set being a matching color to that of one sidewall. The object would be to place colored ball 30 into a respective transparent button member 36 on a matching colored sidewall. Similarly, the number of button members 36 and the size of housing 12 could be increased and the number of balls 30 used correspondingly increased.

It is appreciated that the present invention can take many forms and embodiments. The true essence and the spirit of this invention are defined in the appended claims, and it is not intended that the embodiment of the invention presented herein should limit the scope thereof. Variations obvious to one skilled in the art will be included within the invention defined by the claims.

For instance, the shape of button members 36 can be varied and does not necessarily have to be square in cross-section. Furthermore, it is essential to understand that many variations of the passageways and tunnels can be employed staying within the scope and spirit of the invention. Furthermore, button members 36 do not have to be unitary with the passageways and tunnels, but simply can act as actuators for movement of the passageways and tunnels. Also, passageways and tunnels could be aligned by different means than depressible buttons.

As mentioned before, the number of button members 36 can be varied, as could the shape of housing 12. The number of different variations of tunnels in button members 36 can also be increased. Peepholes 40 could be replaced by transparent windows or other means for verification of location of a game object. It is to be understood that it is preferred that the button members 36 themselves are transparent in the embodiment of invention 10 wherein balls of different colors are matched with buttons on different colored sidewalls.

The starting and finishing locations of the game object or ball 30 do not have to be under transparent covers 26 and 38, but could be in the game buttons 36 themselves. The resilient depressibility of button members 36 could also be achieved by different means.

What is claimed is:

1. A maze gam device comprising:

a housing having top and bottom walls, four sidewalls, and a hollow interior;

transparent covers positioned over said top and bottom walls to contain at least one game object;

at least one aperture in each said top and bottom wall of such size to allow a said object to pass into said housing;

elongated button members extending perpendicular to and through each said sidewall into said housing;

each said button member extending across the interior of said housing to the opposite side and having cut-out tunnel portions along its length through which a said game object is passable;

each said button member being slidably depressible to change the position of said tunnel portions;

said button members of all side walls being interlaid with one another to occupy the entire space of said housing; and so that by depressing one or more of said button members and tilting and orientating said housing, said game object may be maneuvered from outside of said top wall to outside of said bottom wall and back to outside of said top wall.

2. The device of claim 1 wherein there are button members on each sidewall only.

3. The device of claim 2 wherein each said button member is one-fourth the width of said sidewall.

4. The device of claim 3 wherein each button is spaced from every other button an equal distance.

5. The device of claim 1 wherein said button members are resiliently biased so that upon releasing said button after depressment said button will return to its original position.

6. The device of claim 5 wherein said resilient biasing comprises a spring.

7. The device of claim 1 wherein peepholes are placed at the outermost ends of said buttons to allow the user to see and feel if said game object is within a certain button member.

8. The device of claim 1 wherein each sidewall of said housing is a different color from the other sidewalls to allow referencing of sides by said user.

9. The device of claim 8 wherein there is a plurality of game objects being divided into sets of game objects, each set being of a different color corresponding to a color a said side wall of said housing.

10. The device of claim 1 wherein there are a plurality of game objects.

11. The device of claim 10 wherein said plurality of game objects are divided up into set of game objects, each set being of a different color.

12. A maze game device comprising:

a housing having top and bottom walls, four sidewalls, and a hollow interior;

transparent covers positioned over said top and bottom walls to contain at least one game object;

at least one aperture in each said top and bottom wall of such size to allow a said game object to pass into said housing;

elongated button members extending perpendicular to and through each said sidewall into said housing;

each said button member extending across the interior of said housing to the opposite side and having cut-out tunnel portions along its length through which a said game object is passable;

each said button member being slidably depressible to change the position of said tunnel portions;

said button members comprise single action button members and double action button members, said single action button members having only one said tunnel, whereas said double action button members have two said tunnels through which a said game object can pass; and so that by depressing one or more of said button members and tilting and orientating said housing, said game object may be maneuvered from outside of said top wall to outside of said bottom wall and back to outside of said top wall.

13. The device of claim 12 wherein there are button members on each sidewall only.

14. The device of claim 13 wherein each said button member is one-fourth the width of said sidewall.

15. The device of claim 14 wherein each button is spaced from every other button an equal distance.

16. The device of claim 12 wherein said button members are resiliently biased so that upon releasing said button after depressment said button will return to its original position.

17. The device of claim 16 wherein said resilient biasing comprises a spring.

18. The device of claim 12 wherein peepholes are placed at the outermost ends of said buttons to allow the user to see and feel if said game object is within a certain button member.

19. The device of claim 12 wherein each sidewall of said housing is a different color from the other sidewalls to allow referencing of sides by said user.

20. The device of claim 19 wherein there is a plurality of game objects being divided into sets of game objects, each set being of a different color corresponding to a color of a said side wall of said housing.

21. The device of claim 12 wherein there are a plurality of game objects.

22. The device of claim 21 wherein said plurality of game objects are divided up into sets of game objects, each set being of a different color.

* * * * *